United States Patent [19]

Jourde et al.

[11] Patent Number: 4,589,393

[45] Date of Patent: May 20, 1986

[54] SAFETY DEVICE FOR CONSTANT-PRESSURE INJECTION VALVE OF INTERNAL COMBUSTION ENGINE

[75] Inventors: Jean-Pierre Jourde, Lyons; Marc Miettaux, Decines, both of France

[73] Assignee: Regie Nationale des Usines Renault, Boulogne-Billancourt, France

[21] Appl. No.: 691,886

[22] Filed: Jan. 16, 1985

[30] Foreign Application Priority Data

Jan. 23, 1984 [FR] France ..... 84 00973

[51] Int. Cl.[4] ..... F02M 39/00

[52] U.S. Cl. ..... 123/460; 123/198 DB; 137/517

[58] Field of Search ..... 123/198 DB, 198 D, 457, 123/460, 511, 512; 137/517, 498

[56] References Cited

U.S. PATENT DOCUMENTS

| | | | |
|---|---|---|---|
| 2,225,175 | 12/1940 | Koerner | 123/198 DB |
| 3,583,384 | 1/1952 | Mercier | 137/498 |
| 3,735,777 | 5/1973 | Katzer et al. | 137/517 |
| 3,845,785 | 11/1974 | McMath | 137/517 |
| 3,977,430 | 8/1976 | Bushee | 137/517 |
| 4,010,770 | 3/1977 | Peters | 137/517 |

FOREIGN PATENT DOCUMENTS

| | | |
|---|---|---|
| 0061979 | 3/1982 | European Pat. Off. . |
| 2754615 | 6/1979 | Fed. Rep. of Germany . |
| 2125946 | 9/1972 | France . |

*Primary Examiner*—Magdalen Y. C. Moy

*Attorney, Agent, or Firm*—Oblon, Fisher, Spivak, McClelland & Maier

[57] ABSTRACT

A safety device for constant-pressure injection valve of an internal combustion engine. This device blocks the main supply line of the valve permanently and definitely in case the maximum admissible amount of injected fuel is exceeded or the control frequency for a given injected amount, less than the maximum admissible amount, is exceeded. The device is particularly applicable to diesel injection of the pressure-time type.

6 Claims, 12 Drawing Figures

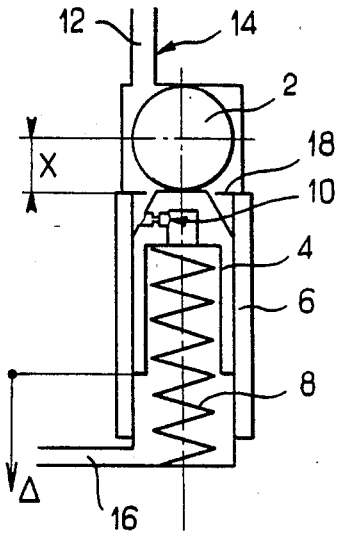
FIG_1
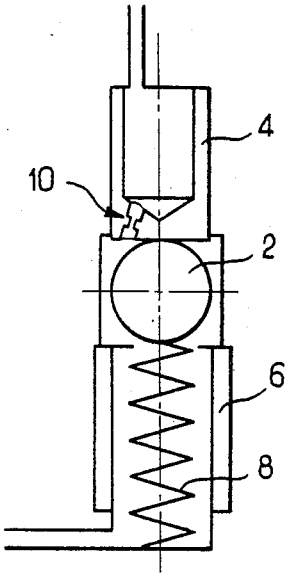
FIG_2
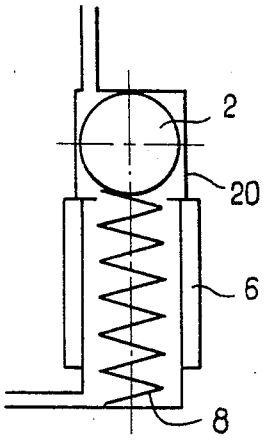
FIG_3
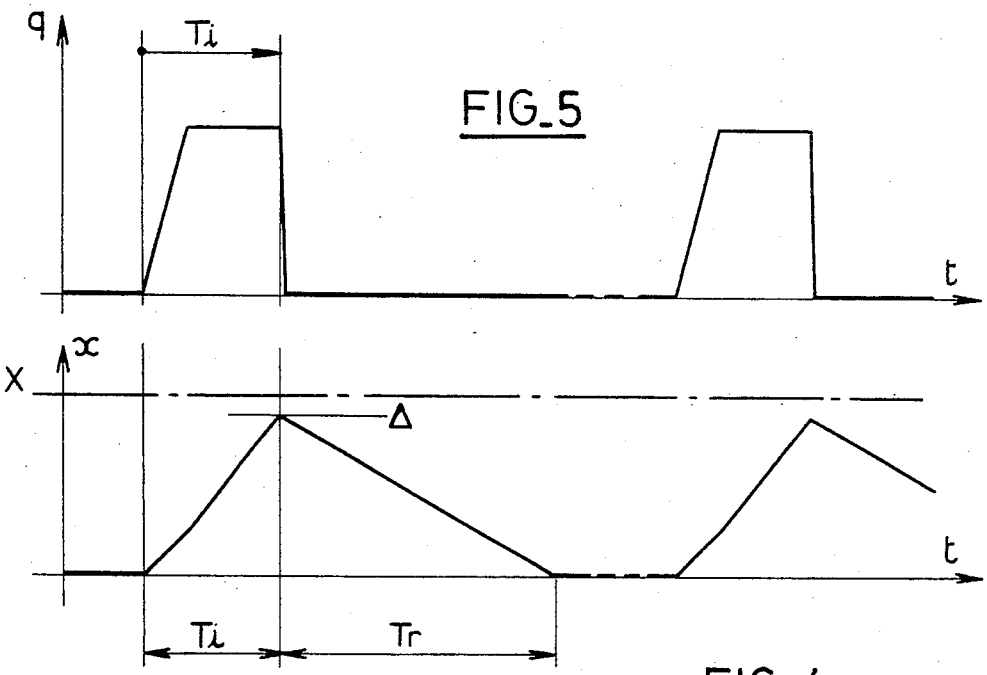
FIG_5
FIG_4

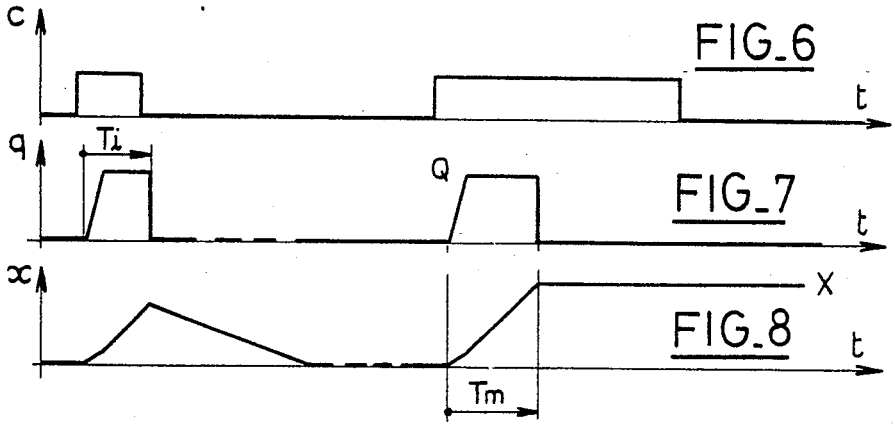
FIG_6
FIG_7
FIG_8
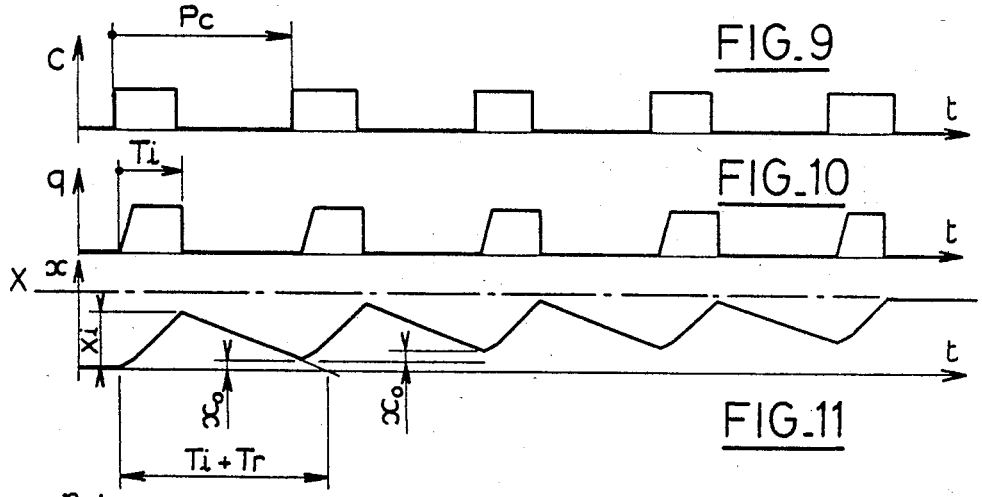
FIG_9
FIG_10
FIG_11
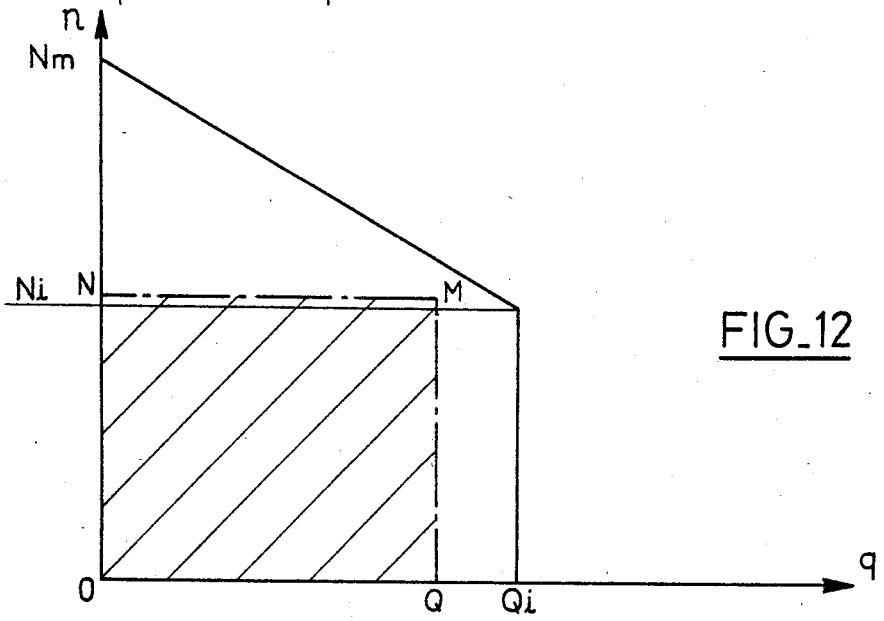
FIG_12

SAFETY DEVICE FOR CONSTANT-PRESSURE INJECTION VALVE OF INTERNAL COMBUSTION ENGINE

BACKGROUND OF THE INVENTION

Field of the Invention

The invention relates to safety devices carried by injection valves of internal combustion engines.

Discussion of Background

The "pressure-time" injection principle is known which is characterized by the use of injection valves, fed under a normally constant pressure, delivering an amount of fuel in proportion to their opening time. Injection valves of this type have the drawback that, in case of jamming of the needle, breaking of the injection nozzle or failure of the control system, it is no longer possible to regulate the amount of fuel injected, it then being possible for the engine to suffer heavy damage.

A known device of this type is described in French patent No. 1 555 369. Such consists of a device placed in the intake line of the injection valve and/or in the exhaust line of the control valve or valves which are operated electromagnetically, which blocks one or the other of the lines described above, in case the maximum admissible amount of injected fuel is exceeded.

This device consists mainly of a piston moving in a bore. This piston is held on one side by a spring and, a line comprising a restriction is arranged parallel to the piston bore, this line coming out in the bore on the spring side. The piston face opposite the spring is connected to the fuel inlet and to the other end of the line mentioned above. The piston face, on the spring side, is connected to the injection valve. When injection occurs, the pressure is lowered on the face of the piston making it move by compressing the spring and, at the end of the injection the piston is returned by the spring. In case the injection valve is defective, the piston undergoes movement so that it comes to block the line described above, thus interrupting the flow. The restriction provided in the line is provided so that the piston can be returned to its original position under the action of the spring between two successive injections, even at very high engine speed.

SUMMARY OF THE INVENTION

The invention has as its object limiting the injection when the amount of injected fuel exceeds a maximum admissible value also when the the engine speed exceeds a given level.

The invention has a further object of providing a device of the type described above which offers an improvement with respect to the following points:

simplicity in production;

reliability of fluid-tightness in case of closing of the device;

indication of the injection valve or valves affected by a defect;

possibility of using other injection valves even though one of them is defective and without loss of fuel in the defective valve; and possibility of putting the engine back into operation by using this type of injection valve even though one of them is defective, without loss of fuel by the latter.

For this purpose, and according to a feature of the invention, this safety device blocks the main supply line of the electromagnetically controlled injection valve, permanently and definitely in case the maximum admissible amount of injected fuel is exceeded or the control frequency for a given injected amount, less than the maximum admissible amount, is exceeded.

According to another feature of the invention, this safety device comprises a ball, a piston provided with a calibrated orifice and placed in series with the main line, a sleeve for guiding this piston and a return spring of this piston, these constitutive elements being assembled, on the one hand, to enable this piston to travel, during each injection, a distance varying as a function of the amount delivered and to return to a rest position between two successive injections by the action of this spring and, on the other hand, to enable this ball to block the sole passage section of this sleeve as soon as the travel of this piston reaches a preset value corresponding to a maximum admissible injected amount.

Other features and advantages of the invention will come out more clearly from reading the following description of three embodiments, given by way of non-limiting examples and with reference to the accompanying drawings in which:

BRIEF DESCRIPTION OF THE DRAWINGS

FIGS. 1, 2 and 3 show diagrammatic viewsof three respective embodiments of a safety device according to the present invention;

FIG. 4 is a curve showing movement of the ball of a safety device shown in FIGS. 1, 2 and 3 as a function of time;

FIG. 5 is a curve corresponding to that of FIG. 4 and showing the variation of the amount of fuel injected as a function of time;

FIGS. 6, 7 and 8 show, for a case of a maximum injection amount being exceeded, variation curves as a function of time, respectively, of the control signal of an electromagnetic valve, of the amount of fuel injected and of the movement of the ball corresponding to one of the safety devices of FIGS. 1, 2 and 3;

FIGS. 9, 10 and 11 show, for the case of engine speed being exceeded, curves similar to those of FIGS. 6, 7, and 8; and FIG. 12 shows an extreme variation curve of the engine speed as a function of the amount of fuel injected with the safety device according to the invention, which makes it possible to define the operating limits of the engine.

DESCRIPTION OF THE PREFERRED EMBODIMENTS

According to the invention, the safety device for a constant-pressure injection valve of an internal combustion engine, as shown in FIG. 1, comprises a ball 2 of diameter D resting on a hollow piston 4 guided by a sleeve 6 and returned by an inside spring 8. This piston 4 comprises a calibrated jet orifice 10 of diameter d which connects inlet 12 of main supply line 14 of an electromagnetically controlled valve (not shown) to outlet 16 of the safety device. Sleeve 6 consists of a metal relatively softer than the material of ball 2, and has a diameter D' for guiding the piston wherein inside diameter of the sleeve is slightly less than diameter D of the ball.

The center of ball 2 is separated from edge 18 of sleeve 6 and $\epsilon$ representing a constant, the proportion of which over the maximum movement X is negligible by a maximum distance $X+\epsilon(\epsilon>0)$, X representing the maximum movement of this ball until contact with sleeve 6.

According to another embodiment shown in FIG. 2, the piston is placed above the ball lifted by the return spring.

Another embodiment shown in FIG. 3 can be adopted by providing play between the ball and bore 20 in which the ball moves, so that the passage section thus defined is identical with that of d of jet 10 shown in FIGS. 1 and 2.

With reference to FIGS. 1 to 12, the safety device described above functions as follows. At the moment of injection, a low pressure is produced at outlet 16 of the safety device in line 14. This causes a movement $\Delta$ of piston 4 by the effect of the pressure drop existing between the two piston faces by means of calibrated orifice 10. At the end of injection, the amount Q that will have been delivered will be: $Q=\pi/4.D'^2.\Delta$. The delivery is stopped because of closing of the injector, and the low pressure at outlet 16 disappears. Return spring 8 then biases piston 4 and ball 2 and puts them back in their initial positions in expectation of the next injection.

In case of failure, for example where too great an injection time period occurs, an injector remaining open or a fuel leak occurring, the movement of piston 4 reaches a value $\Delta=X$. At this moment, the delivery is stopped by the interpositioning of ball 2 in guide sleeve 6, on the one hand, and since the entire pressure of the circuit is exerted on the section of ball 2, it is thrust against this sleeve of inside diameter $D'(D'<D)$ under the effect of the force thus created. Since this thrusting force is considerably greater than the force of return spring 8, the ball maintains this resting position and completely isolates the defective circuit.

FIG. 4 shows the movement of ball 2 resting on piston 4 as a function of time. This movement and the injection delivery shown in FIG. 5 are synchronized during a time Ti. The return time of the ball under the effect of the return spring corresponds to Tr. The sum Ti+Tr is provided at a value slightly less than an injection period. Value X represents the maximum travel of the ball, provided to allow the maximum amount of fuel to be injected, which causes locking of the safety device.

FIGS. 6, 7 and 8 show a case of a maximum injected amount being exceeded, causing the safety application. The second control signal pulse shown in FIG. 6 for an electromagnetic valve is extended for too long a time period injection time Ti then reaches a set value Tm causing a maximum movement X of the ball, which causes the safety application (cf FIGS. 7 and 8).

FIGS. 9, 10 and 11 show a case of the engine speed being exceeded, causing safety application.

FIG. 9 shows the periodic control signal of an electromagnetic valve. FIG. 10 shows the amount injected as a function of time. As can be seen in FIG. 11, period Pc of the control signal is less than the sum (Ti+Tr) representing the period pertaining to the safety device. On the return of ball 2, such cannot resume its rest position and is offset a value $x_o$ (cf FIG. 11); at each injection, the movement of the ball increases by the value $x_o$. When equality in valve of X with $Xi+nx_o$ is reached, the device is put on safety (Xi represents the initial movement of the ball and n the number of abnormal injections).

FIG. 12 shows the overall functioning of the safety device with point Qi indicating the maximum amount that can be injected, point Ni indicating the start of the regression of the maximum delivery as a function of engine speed, point Nm indicating the maximum speed that can theoretically be obtained with a very slight amount injected. The limits of the functioning of the engine should be circumscribed within this trapezoid, for example, rectangle OQMN.

Obviously, numerous modifications and variations of the present invention are possible in light of the above teachings. It is therefore to be understood that within the scope of the appended claims, the invention may be practiced otherwise than as specifically described herein.

We claim:

1. A safety device for a constant-pressure injection valve of an internal combustion engine having a main fuel supply line, comprising:

means for blocking said main supply line of said valve permanently and definitely upon a maximum admissible amount of injected fuel being exceeded and which further comprises:

a ball;

a piston having a calibrated orifice formed therein and placed in series with said main supply line;

a sleeve for guiding said piston and a return spring positioned within said piston for biasing said piston such that, on the one hand, said piston travels, during each fuel injection, a distance varying as a function of the amount of fuel delivered and returned to a rest position between two successive fuel injections by the action of said spring and, on the other hand, said ball blocks said sleeve as soon as travel of said piston reaches a preset value corresponding to a maximum admissible fuel injected amount.

2. A safety device for a constant-pressure injection valve of an internal combustion engine having a main fuel supply line, comprising:

means for blocking said main supply line of said valve permanently and definitely upon a maximum admissible amount of injected fuel being exceeded and which further comprises:

a ball;

a bore within which said ball is movable and which defines a passage between said bore and said ball to throttle flow of fuel thereby;

a sleeve; and a return spring for biasing said ball towards said main fuel supply line such that, on the one hand, said ball travels, during each fuel injection, a distance varying as a function of the amount of fuel delivered and travels through said bore with a predetermined play, and returns to a rest position between two successive fuel injections by action of said spring and, on the other hand, said ball blocks said sleeve as soon as travel of said ball reaches a preset value corresponding to a maximum admissible injected amount.

3. A safety device for a constant-pressure injection valve of an internal combustion engine having a main fuel supply line, comprising:

means for blocking said main supply line of said valve permanently and definitely upon a control frequency for a given injected amount, less than a maximum admissible amount, is exceeded and which further comprises:

a ball;

a piston having a calibrated orifice formed therein and placed in series with said main supply line;

a sleeve for guiding said piston and a return spring positioned within said piston for biasing said piston such that, on the one hand, said piston travels, during each fuel injection, a distance varying as a function of the amount of fuel delivered and returned to a rest position between two successive fuel injections by the action of said spring and, on the other hand, said ball blocks said sleeve as soon as travel of said piston reaches a preset value corresponding to a maximum admissible fuel injected amount.

4. A safety device for a constant-pressure injection valve of an internal combustion engine having a main fuel supply line, comprising:

means for blocking said main supply line of said valve permanently and definitely upon a control frequency for a given injected amount, less than a maximum admissible amount, is exceeded and which further comprises:

a ball;

a bore within which said ball is movable and which defines a passage between said bore and said ball to throttle flow of fuel thereby;

a sleeve; and a return spring for biasing said ball towards said main fuel supply line such that, on the one hand, said ball travels, during each fuel injection, a distance varying as a function of the amount of fuel delivered and travels through said bore with a predetermined play, and returns to a rest position between two successive fuel injections by action of said spring and, on the other hand, said ball blocks said sleeve as soon as travel of said ball reaches a preset value corresponding to a maximum admissible injected amount.

5. A safety device for a constant-pressure injection valve for an internal combustion engine having a main fuel supply line, comprising:

means for blocking said main supply line of said valve permanently and definitely upon a maximum admissible amount of injected fuel being exceeded and which further comprises:

a hollow piston having a calibrated orifice formed therein and within which a chamber is formed in communication with said main supply line;

a sleeve;

a ball positioned between said piston and said sleeve; and a return spring for biasing said ball toward said piston such that, on the one hand, said ball travels during each fuel injection, a distance varying as a function of the amount of fuel delivered and returns to a rest position between two successive fuel injections by action of said spring and, on the other hand, said ball blocks said sleeve as soon as travel of said ball reaches a preset value corresponding to a maximum admissible injected amount.

6. A safety device for a constant-pressure injection valve for an internal combustion engine having a main fuel supply line, comprising:

means for blocking said main supply line of said valve permanently and definitely upon a control frequency for a given injected amount, less than a maximum admissible amount, being exceeded and which further comprises:

a hollow piston having a calibrated orifice formed therein and within which a chamber is formed in communication with said main supply line;

a sleeve;

a ball positioned between said piston and said sleeve; and a return spring for biasing said ball toward said piston such that, on the one hand, said ball travels during each fuel injection, a distance varying as a function of the amount of fuel delivered and returns to a rest position between two successive fuel injections by action of said spring and, on the other hand, said ball blocks said sleeve as soon as travel of said ball reaches a preset value corresponding to a maximum admissible injected amount.

* * * * *